US008220373B1

(12) United States Patent
Husting et al.

(10) Patent No.: US 8,220,373 B1
(45) Date of Patent: Jul. 17, 2012

(54) MACHINE WITH A TILTING HARP

(75) Inventors: Jonah D. Husting, Sheboygan, WI (US); Thomas J. Husting, Sheboygan Falls, WI (US)

(73) Assignee: General Machinery Corporation, Sheboygan, WI (US)

( * ) Notice: Subject to any disclaimer, the term of this patent is extended or adjusted under 35 U.S.C. 154(b) by 865 days.

(21) Appl. No.: 12/324,521

(22) Filed: Nov. 26, 2008

Related U.S. Application Data

(60) Provisional application No. 61/004,658, filed on Nov. 28, 2007.

(51) Int. Cl.
*B26D 3/26* (2006.01)

(52) U.S. Cl. ..... 83/431; 83/404.3; 83/130

(58) Field of Classification Search ..... 83/13, 408, 83/425.4, 435.1, 437, 651.1, 404.3, 662, 83/431, 467, 425, 425.2, 404, 404.1; 30/117
See application file for complete search history.

(56) References Cited

U.S. PATENT DOCUMENTS 872,422 A * 12/1907 Hodell ..... 83/651.1
874,133 A * 12/1907 Stevens ..... 83/435.18
1,931,982 A * 10/1933 Faillers ..... 83/212.1
3,510,944 A * 5/1970 Johanski, Jr. ..... 83/14
4,103,579 A 8/1978 Rowe
4,346,634 A * 8/1982 Jones ..... 83/431
4,646,602 A * 3/1987 Bleick ..... 83/408
5,117,717 A 6/1992 Mally
5,311,803 A 5/1994 Crowley
5,367,932 A * 11/1994 Bergman ..... 83/425.2
5,617,634 A 4/1997 Moesmann
6,655,248 B1 12/2003 Johnson

* cited by examiner

*Primary Examiner* — Ghassem Alie

(74) *Attorney, Agent, or Firm* — Brannen Law Office, LLC

(57) ABSTRACT

The present invention has a harp with four arms forming a parallelogram. The four arms are pivotally connected at their respective ends. Wires are secured between the side arms of the harp with holders. The harp is securely received within a channel of the machine. As such, the harp lies in a plane that is parallel to the front of the product being sliced at all times. The harp is angularly adjustable, such that the top and bottom of the harp can selectably converge or diverge as the harp tilts. The wires remain parallel during the divergence and convergence of the top and bottom of the harp. An actuator is provided for effecting the tilting of the harp. Two vertical bars can be provided for supporting the wires and minimizing deflection of the wires along their respective lengths.

4 Claims, 12 Drawing Sheets

MACHINE WITH A TILTING HARP

This United States utility patent application claims priority on and the benefit of provisional application 61/004,658 filed Nov. 28, 2007, the entire contents of which are hereby incorporated herein by reference.

BACKGROUND OF THE INVENTION

1. Field of the Invention

The present invention relates to a slicing machine and in particular to an improved design for an adjustably tilting harp used to slice products into exact volumes.

2. Description of the Related Art

While the present invention is useful for slicing products of any material into pieces having exact volumes, it is of particular importance in the food industry, and in the cheese industry in particular.

In a traditional setting, cheese has been produced by relatively small manufacturers. The manufacturers would typically cut the cheese manually, and individually weigh each package. This process was improved slightly with mechanical slicers. Yet, each package would still be weighed individually in order to determine the package price. Drawbacks of this approach are plentiful. For example, the process of weighing individual packages is time consuming and labor intensive. Even when mechanical weighers are used, there still is a capital requirement for purchase and maintenance of the weighing machines.

For this or other reasons, tilting harps have been developed. One example is shown in U.S. Pat. No. 6,655,248 to Johnson titled Cheese Cutting. This patent shows a cutter for cutting food into consumer-size chunks. A cutting harp is shown. Blocks of cheese are moved towards and through the harp.

The harp in this patent and in other cutters can be tilted relative the plane of the front of the cheese. This is accomplished by having an actuator adjust the angle of the harp relative the front of the cheese.

One drawback of this configuration is that it is very difficult to use a single ram to cut all the way through the cheese, especially when the harp is used in a relatively large angularly adjusted position. Instead, the ram would contact the wires near the bottom prior to pushing the top of the cheese through the harp. This is disadvantageous as additional processes are required to complete the process of cutting of the cheese. This problem is exacerbated as the angle of the tilting harp increases.

An additional drawback of this arrangement is that the angle of the harp cannot be adjusted during the middle of a cutting cycle. This is demonstrated in the Johnson patent, as weight to volume ratios are calculated after a cut, and the harp is adjusted for the next cycle. A drawback of this and other approaches is that excess product can be added to each package where until the dimensions of each cut are correct. While this may be preferable to consumers, such a result adversely affects the manufacturers.

A further drawback of this arrangement is that the force of the cheese passing through the harp places a force against harp actuator that controls the angle of the harp. Over time, the forces can shorten the lifespan of the actuator resulting in premature failure of the machine.

Thus there exists a need for a cutting machine that solves these and other problems.

SUMMARY OF THE INVENTION

The present invention relates to a slicer and in particular to an improved design for an adjustably tilting harp used to slice products into exact volumes. In a preferred embodiment, the present invention has a harp comprised of four arms forming a parallelogram. The four arms are pivotally connected at their respective ends. Wires are secured between the side arms of the harp. The harp is securely received within a channel of the machine. As such, the harp lies in a plane that is parallel to the front of the cheese at all times. The harp is angularly adjustable, such that the top and bottom of the harp can selectably converge or diverge as the harp tilts within the plane parallel to the front surface of the cheese. The wires remain parallel during the divergence and convergence of the top and bottom of the harp. An actuator is provided for effecting the tilting of the harp. The actuator acts within the plane generally parallel to the front surface of the cheese. Two vertical bars can be provided for supporting the wires and minimizing deflection of the wires along their respective lengths.

According to one advantage of the present invention, a single and simple plate can push the cheese all the way through the harp regardless of the angle of the harp. This is advantageously accomplished by having the harp tilt in a plane that is generally parallel to the front surface of the cheese.

According to another advantage of the present invention, the harp can be adjusted mid-cycle before the slicing or cutting begins. This is accomplished by determining the density (by measuring weight and volume) of the cheese and adjusting the angle of the harp to achieve a calculated piece height and accordingly piece weight.

According to a further advantage of the present invention, the tilting actuator is free of parasitic stress. This is accomplished by having the harp remain secured within a channel and operating within a plane parallel to the front surface of the cheese. The actuator is not subject to the forces developed as the cheese passes through the harp.

According to a still further advantage of the present invention, the stroke of the main ram is constant. This advantageously allows the engineers to optimize the operation of the actuator. Since stroke length is constant, optimization of speed and minimization of required actuator requirements can be achieved. This potentially can result in less capital investment and operational costs.

According to a still further advantage yet of the present invention, two vertical support bars are provided. These support bars perform several advantageous functions. First, the vertical bars are contained within slots in the top arm of the invention. The bottom arm of the invention can be stationary, and can have the vertical bars stationarily received within respective holes. The vertical bars then limit the travel of the top arm of the invention relative the bottom arm, as movement of the top arm is limited by the location of the vertical bars within the slots.

A second advantage of the vertical bars is that they provide support to the wires to limit the amount of deflection in the wires.

A third advantage of the vertical bars is that they provide longitudinal support within the mounting system.

According to a still further advantage yet of the present invention, the string tension remains constant within the harp as it is tilted to its selected orientation within a plane generally parallel to the front of the cheese. This is accomplished by having holders act in tandem. The holders can pivot about respective sides of the harp and maintain the parallel alignment of the wires as the harp and wires selectably converge or diverge.

According to a still further advantage yet of the present invention, the harp is easily removable from the machine.

Cleaning and maintenance of the harp is easily accomplished. Further, multiple harps having varying wire sizes can be easily and rapidly interchanged.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
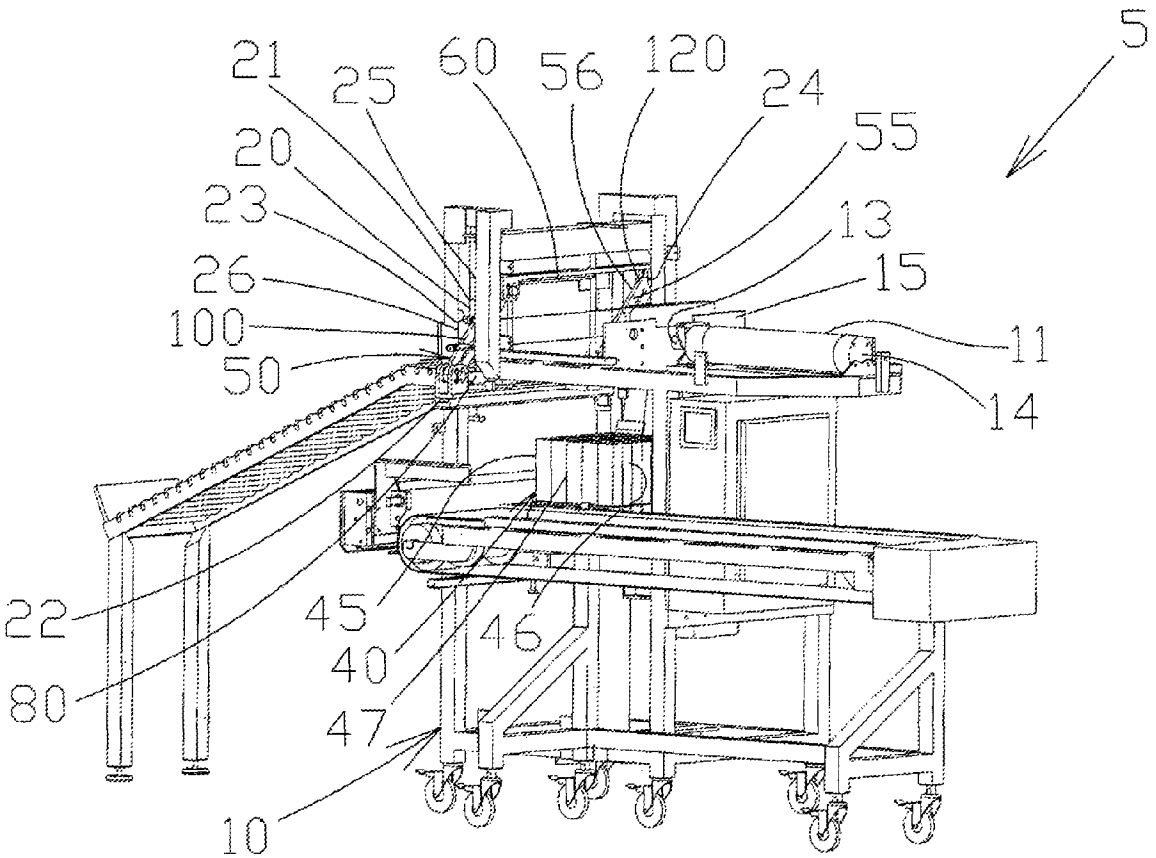
FIG. 1 is a perspective view of a preferred embodiment of a cutting machine.
Figure 2:
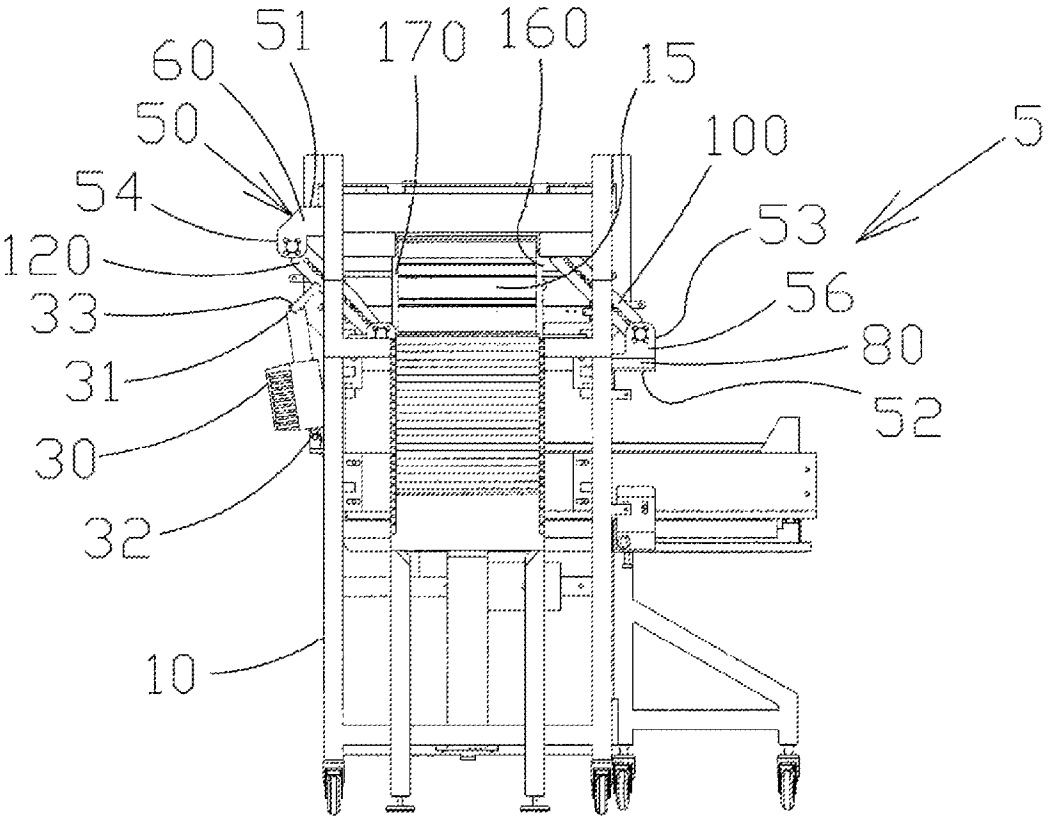
FIG. 2 is an end view of the preferred embodiment shown in FIG. 1.
Figure 3:
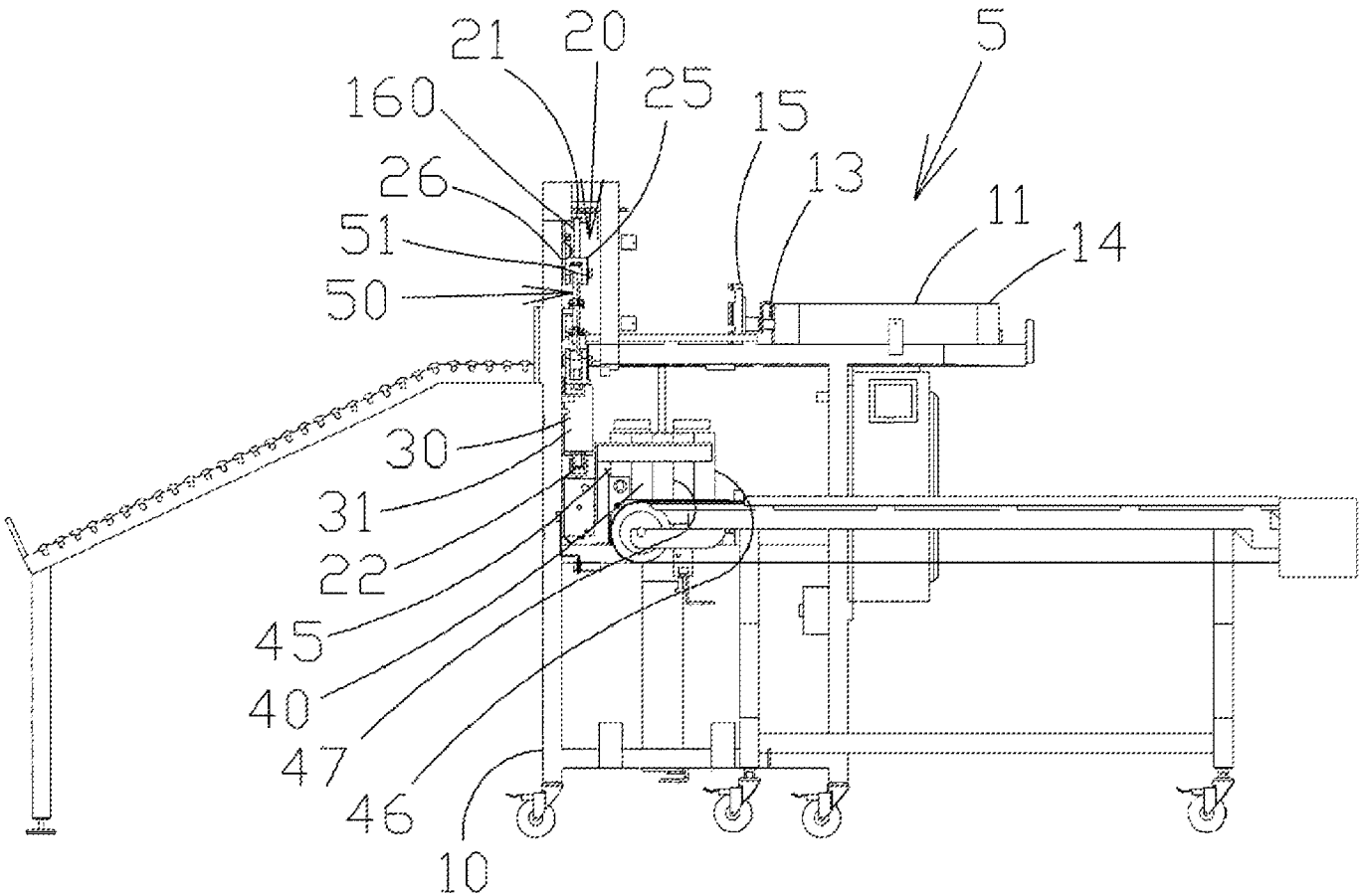
FIG. 3 is a side view of the preferred embodiment shown in FIG. 1.
Figure 4:
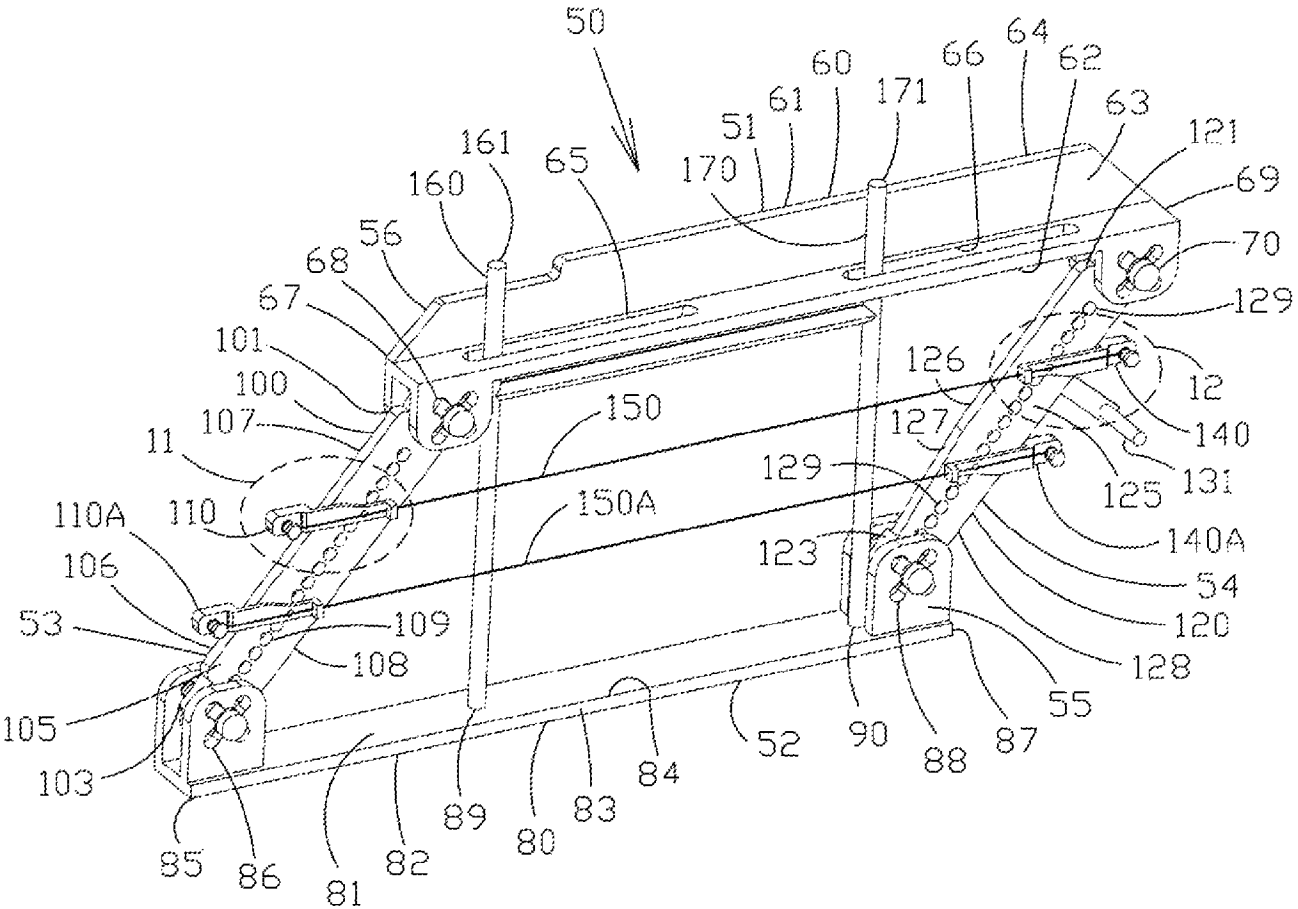
FIG. 4 is a perspective view of a preferred embodiment of a harp of the present invention shown at a position of maximum convergence.
Figure 5:
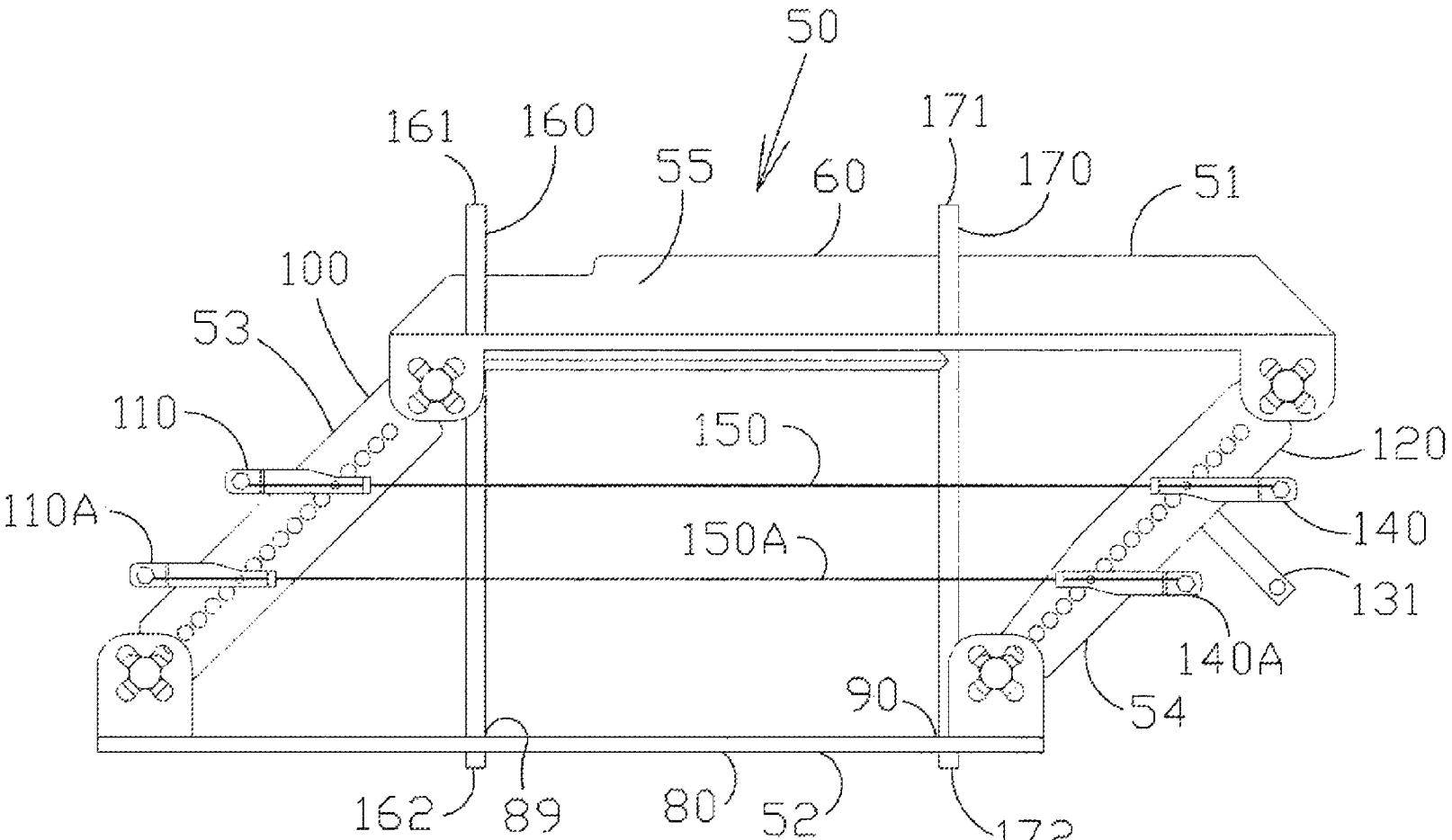
FIG. 5 is a front view of the preferred embodiment shown in FIG. 4
Figure 6:
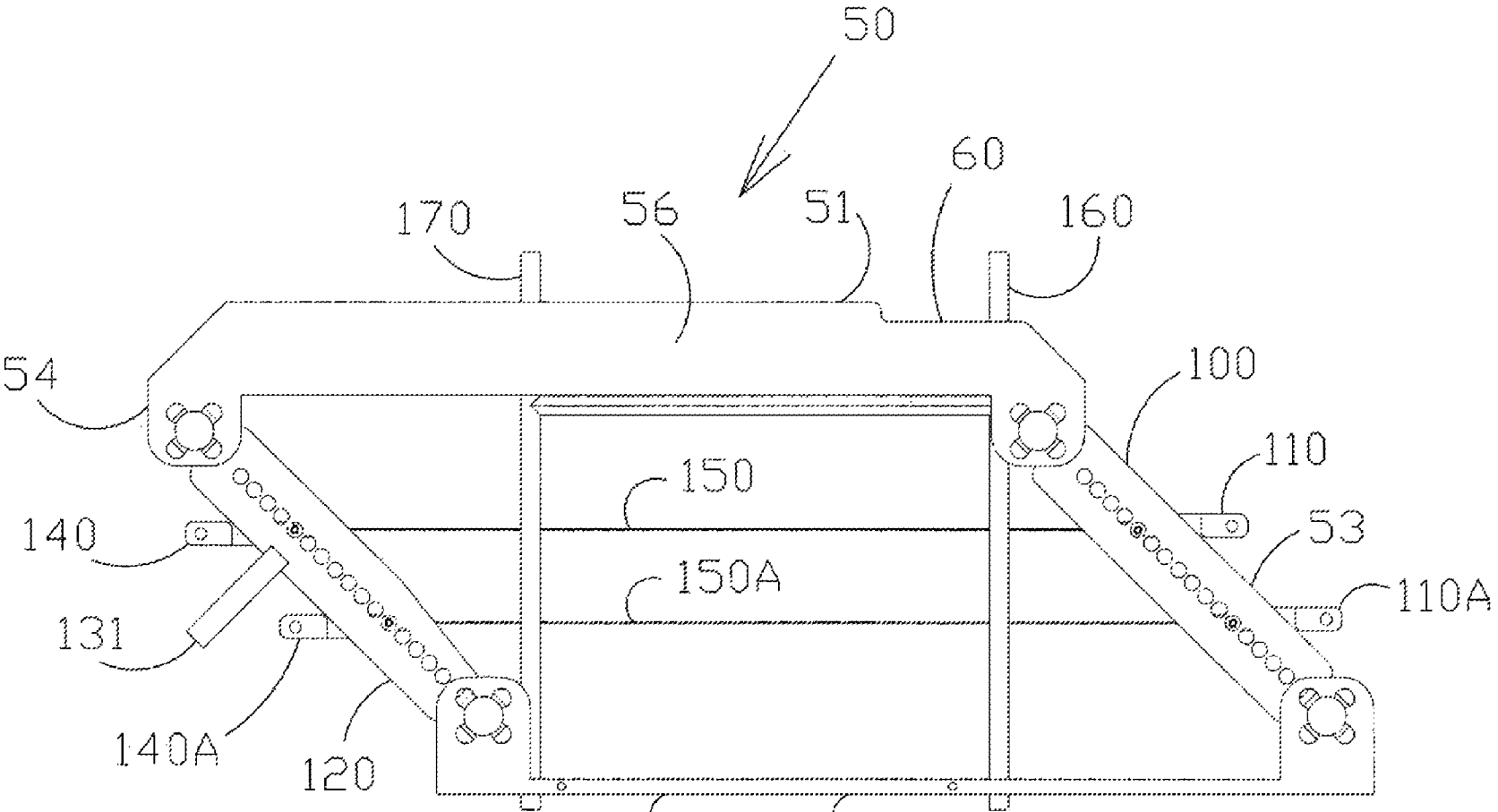
FIG. 6 is rear view of the preferred embodiment shown in FIG. 4.
Figure 7:
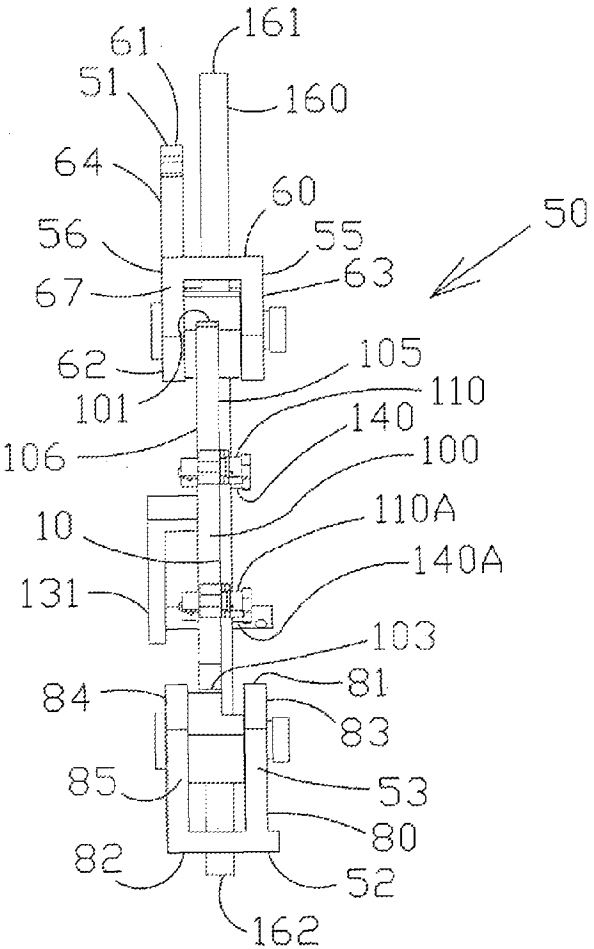
FIG. 7 is an end view of the preferred embodiment shown in FIG. 4.
Figure 8:
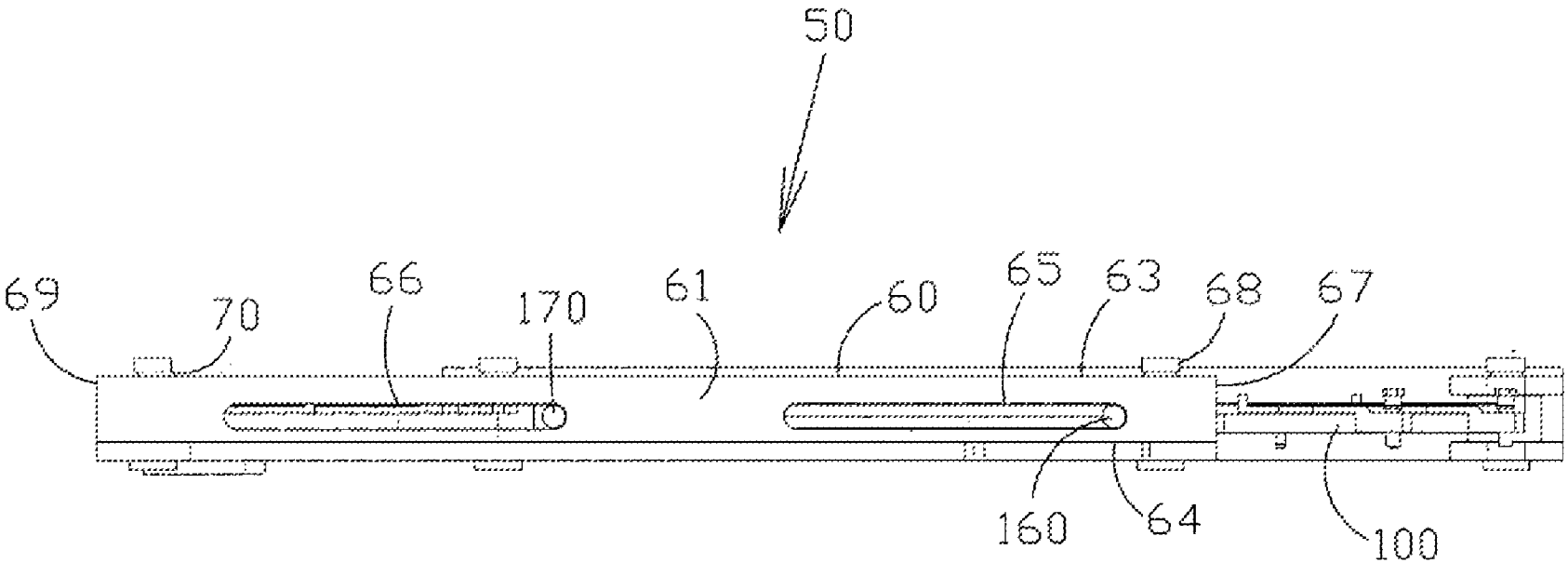
FIG. 8 is a top view of the preferred embodiment shown in FIG. 4.

Looking now to FIGS. 1-3, a preferred embodiment of the overall machine 5 is illustrated. The machine 5 has a frame 10 and can be movably supported by several castors. A drive actuator 11 is provided. The drive actuator 11 has a first end 13 and an opposed second end 14. A plate 15 is attached to end 13 of a ram. The plate 15 pushes a block of cheese 40 (described below) or other product through the cutting or slicing portion of the machine 5. The plate 15 is preferably has a planar front face that lies in a plate plane. It is appreciated that the actuator 11 is a linear drive actuator, and can be a pneumatic actuator. In one embodiment, the actuator can apply a force of approximately 1000 pounds. It is appreciated that the actuator can provide more or less force without departing from the broad aspects of the present invention.

A channel 20 is bound within the frame 10. The channel 20 has a top 21, a bottom 22, sides 23 and 24 respectively, a front 25 and a rear 26. The front 25 preferably lies in a plane that is generally parallel to the plate plane of plate 15. A harp 50 (as described below) is removably received within the channel 20.

A harp actuator 30 is further provided. The harp actuator 30 has ends 31 and 32. A connector 33 is provided for removably connecting end 32 to the harp 50. The actuator 30 can selectably vary the angle of the harp 50 as described below. Harp actuator 30 is preferably a linear drive actuator, and can provide approximately sixty pounds of force.

As mentioned, a cheese block 40 is provided for being cut or sliced by the present invention. It is well understood that other food objects or non-food objects could be cut or sliced without departing from the broad aspects of the present invention. The block 40 has a top and a bottom, a first side and a second side, and a front 45 and a rear 46. The front 45 of the block is preferably planar and lies in a block plane that is generally parallel to the plate plane of plate 15. Several vertical cuts 47 can be formed through the block 40 prior to the block passing through the harp 50. The cuts 47 are made both laterally across the block between the sides and longitudinally between the front 45 and the rear 46.

It is understood that the block 40 is weighed prior to passing through the harp 50. The proper size of each consumer-size piece of product can then be determined in advance of being passed through the harp 50. The harp 50 is adjustable (as described below) so that the product will have the desired size equal to the intended weight. In FIGS. 1-3, the block is shown in a position where it can be weighed and volumetrically measured. After the density is determined, the block can be moved up to the slicing position adjacent ram plate 15 and the harp 50 can be adjusted for a desired distance between the wires.

Turning now to FIGS. 4-11, a preferred embodiment of the harp is illustrated. The harp 50 has a top 51, a bottom 52, a side 53, a side 54, a front 55 and a rear 56. The front 55 preferably lies in a harp plane that is parallel to the plate plane of plate 15. The harp 50 preferably comprises four arms that are pivotally linked at their respective ends. The harp 50 has a generally parallelogram shape, such that the top 51 and bottom 52 remain parallel, and the sides 53 and 54, respectively, remain parallel during the tilting of the harp.

The four arms are a top arm 60, a bottom arm 80, a first side arm 100 and a second side arm 120. Each of these arms is described below.

Top arm 60 has a top 61 and a bottom 62, a front 63 and a rear 64, and an end 67 and an end 69. A slot 65 is through the top arm 60 from the top 61 to the bottom 62. Slot 65 is bound by two ends. Slot 65 is near end 67 of the top arm 60. A second slot 66 is also provided. The second slot 66 bound by two ends. Slot 65 is near the end 69 of the top arm 60. It is appreciated that the ends of the slots, respectively, can act as motion limiters and can define the tilting range of the harp 50. A first hole 68 is through the top arm adjacent the first end 67, and a second hole 70 is through the top arm adjacent end 69.

Bottom arm 80 has a top 81 and a bottom 82, a front 83 and a rear 84, and an end 85 and an end 87. A first hole 86 is through the bottom arm 80 adjacent end 85, and a second hole 88 is through the bottom arm adjacent end 87. Two vertical holes 89 and 90, respectively, are through the bottom arm 80 between the ends 85 and 87.

Side arm 100 has a top 101 with a hole adjacent thereto. Side arm 100 also has a bottom 103 with a hole adjacent thereto. A front 105, a rear 106 and sides 107 and 108 are further provided. A series of holes 109 are illustrated. The holes 109 preferably extend from the front 105 and are equally spaced from each other. The holes are spaced apart a selected amount. It is appreciated that the vertical component of the distance between the centers of the holes, respectively, decreases, and the harp approaches maximum convergence, and the vertical component of the distance between the holes is at their maximum at the point of harp maximum divergence.

Side arm 120 has a top 121 with a hole adjacent thereto. Side arm 120 also has a bottom 123 with a hole adjacent thereto. A front 125, a rear 126, and sides 127 and 128 are further provided. A series of holes 129 are illustrated. Holes preferably extend from the front 125 of the arm 120 and are equally spaced from each other. The holes are spaced apart a selected amount. It is appreciated that the vertical component of the distance between the centers of the holes, respectively, decreases, and the harp approaches maximum convergence, and the vertical component of the distance between the holes is at their maximum at the point of harp maximum divergence.

A connecting arm 131 is on the side 128 of the arm 120. The connecting arm can project forward of the side arm 120 and can have an axis that is generally perpendicular to the plane of the harp 50

The four arms 60, 80, 100 and 120 are pivotally connected to each other. This is accomplished through the use of pins that extend through the respective holes adjacent the ends of the arms. End 67 of arm 60 is pivotally connected to the top 101 of arm 100. The bottom 103 of arm 100 is pivotally connected to end 85 or arm 80. End 87 of arm 80 is pivotally connected to the bottom 123 of arm 120. The top 121 of arm 120 is pivotally connected to the end 69 or arm 60. The parallelogram arrangement of the arms results in an adjustably tiltable harp 50. The front 55 of the harp remains planar within a plane parallel to the plate plane of plate 15 regardless of the angular orientation of the harp 50.

The harp actuator 30 is pivotally connected to side arm 120, and in particular by being pivotally connected with the connecting arm 131. The harp actuator 30 selectably tilts the angle of sidewall 120, which in turn causes the top and bottom arms to selectably converge or diverge. Tilting of the harp 50 adjusts the distance between the wires (described below).

Figure 11:
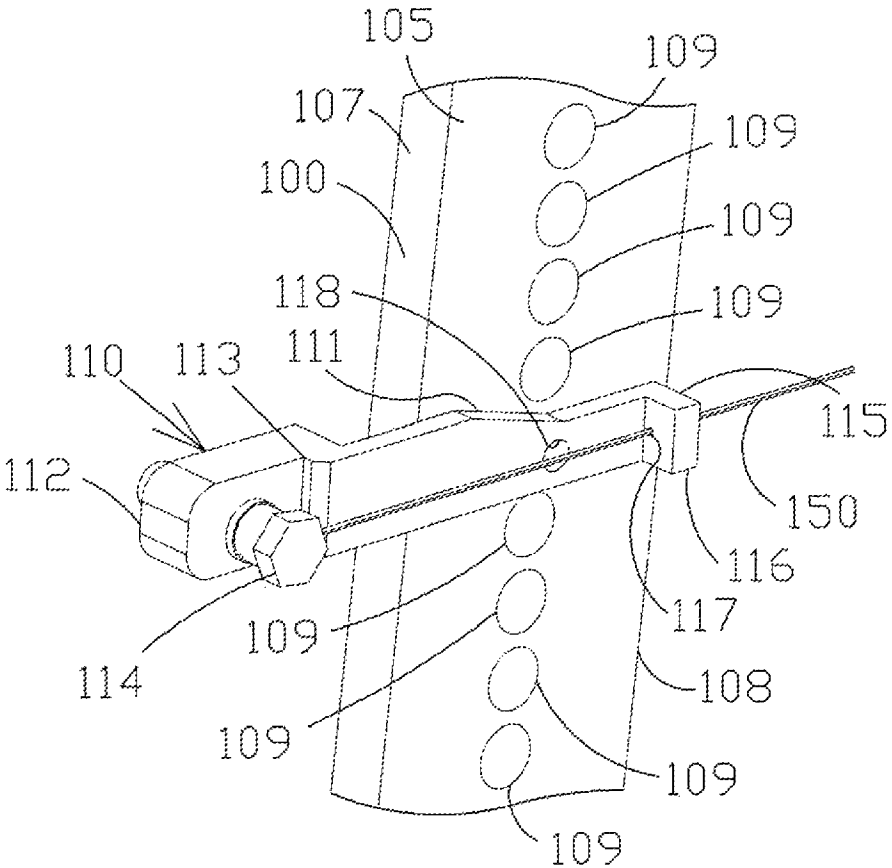
FIG. 11 is a close up view of a holder taken from circle 11 shown in FIG. 4.

Looking now to FIG. 11, a first holder 110 is shown. Holder 110 has an arm 111 with a first end 112 and a second end 115. A detent 113 with a wire screw 114 is at the first end 112 of the holder. A lip 116 with a hole 117 there though is at the second end 115 of the holder 110. A pivot 118 is further provided. The arm 111 has a longitudinal axis. The pivot 118 is generally perpendicular to the longitudinal axis of the arm. The hole 117 has an axis that is aligned with the longitudinal axis of the arm. The pivot preferably intersects the longitudinal axis of the arm, such that hole 117 is aligned with the center of the pivot. A holder 110A is also illustrated.

Figure 12:
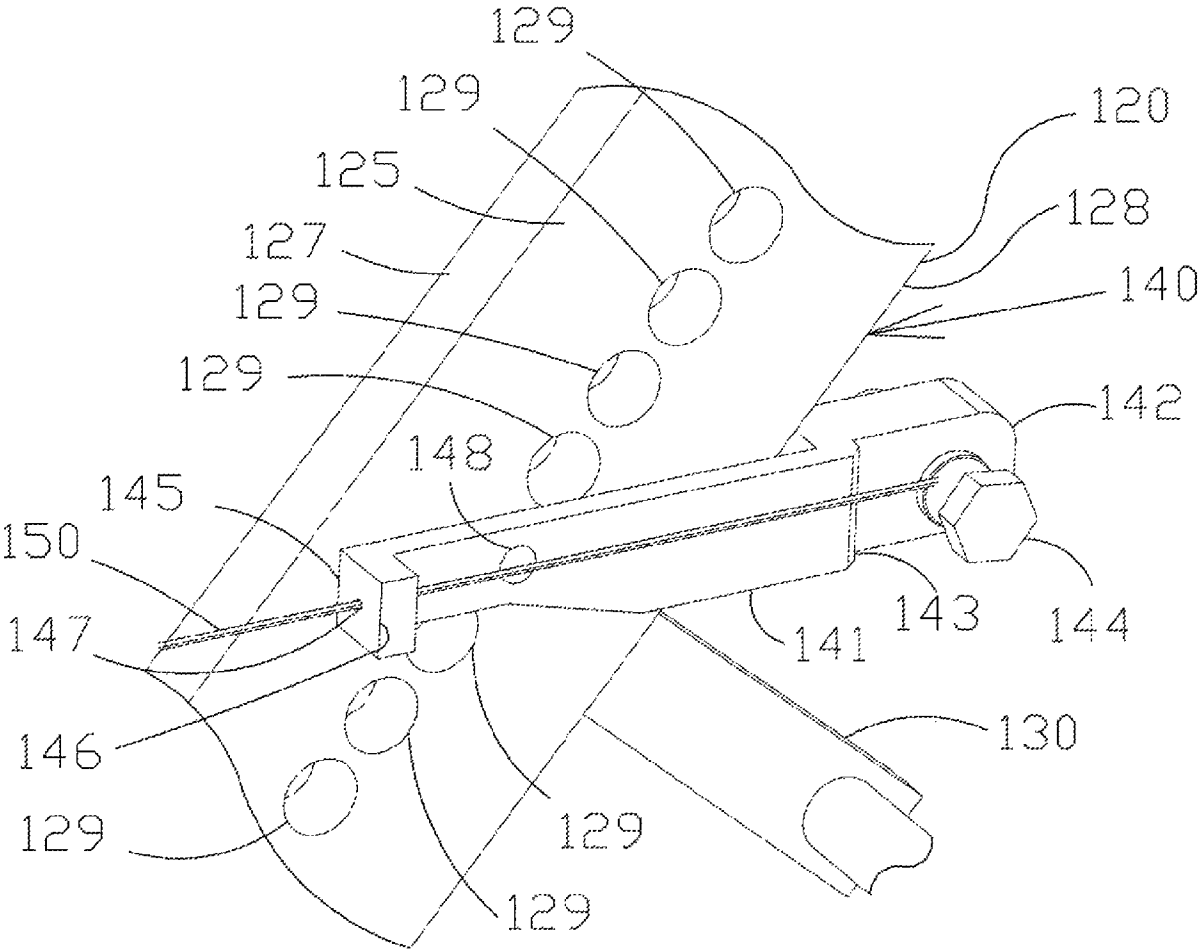
FIG. 12 is a close up view of a holder taken from circle 12 shown in FIG. 4.

Looking now to FIG. 12, a first holder 140 is shown. Holder 140 has an arm 141 with a first end 142 and a second end 145. A detent 143 with a wire screw 144 is at the first end 142 of the holder. A lip 146 with a hole 147 there though is at the second end 145 of the holder 140. A pivot 148 is further provided. The arm 141 has a longitudinal axis. The pivot 148 is generally perpendicular to the longitudinal axis of the arm. The hole 147 has an axis that is aligned with the longitudinal axis of the arm, such that hole 147 is aligned with the center of the pivot. A holder 140A is also illustrated.

It is appreciated that holders 110 and 140 may be identical in structure.

It is seen in many FIGS. that a wire 150 is provided. The wire 150 has a first end 151 wound onto screw 114 and a second end 152 wound onto screw 144. A second wire 150A is also illustrated. It is appreciated that wire 150 and wire 150A are parallel, and both have a predetermined wire tension. Wires 150 and 150A remain parallel during the full range of divergence and convergence of the wires. The wires move closer together as the harp converges, and move further apart as the harp diverges. The wires stay parallel due to the fact the holders 110 and 140 (and 110A and 140A) are able to pivot around their respective pivots. In this regard, it is seen that the holders act in tandem.

It is appreciated that there may be more or fewer wires without departing from the broad aspects of the present invention. Further, the holders may be selectively positioned in any hole 109 and/or 129 depending on the desired cutting characteristics without departing from the broad aspects of the present invention.

A vertical bar 160 is provided having a top 161 and a bottom 162. A vertical bar 170 is also provided having a top 171 and a bottom 172. The bottom 162 of vertical bar 160 is received within hole 89 through the bottom arm 80, and the bottom 172 of vertical bar 170 is received within hole 90 through the bottom arm 80. The top 161 of vertical bar 160 passes through the slot 65 in the top arm 60. In this regard, the top arm 60 is limited in movement where the ends of the slot contact or engage the bar 160. The top 171 of vertical bar 170 passes through the slot 66 in the top arm 60. In this regard, the top arm 60 is limited in movement where the ends of the slot 66 contact or engage the bar 170.

In operation, the machine 5 can take height, width and length measurements, and a weight measurement, of the block 40 prior to passing through the harp 50. In this regard, the height of the end product pieces can be determined and the harp 50 can be adjusted accordingly.

Turning now to FIGS. 4-8, the harp 50 is illustrated to be in a position wherein the wires are in a state of maximum convergence and minimum convergence. In this regard, distance between the wires 150 and 150A is minimized when the harp 50 is in this illustrated position. The vertical bars 160 and 170 are all the way to a first end, respectively, of slots 65 and 66.

Figure 9:
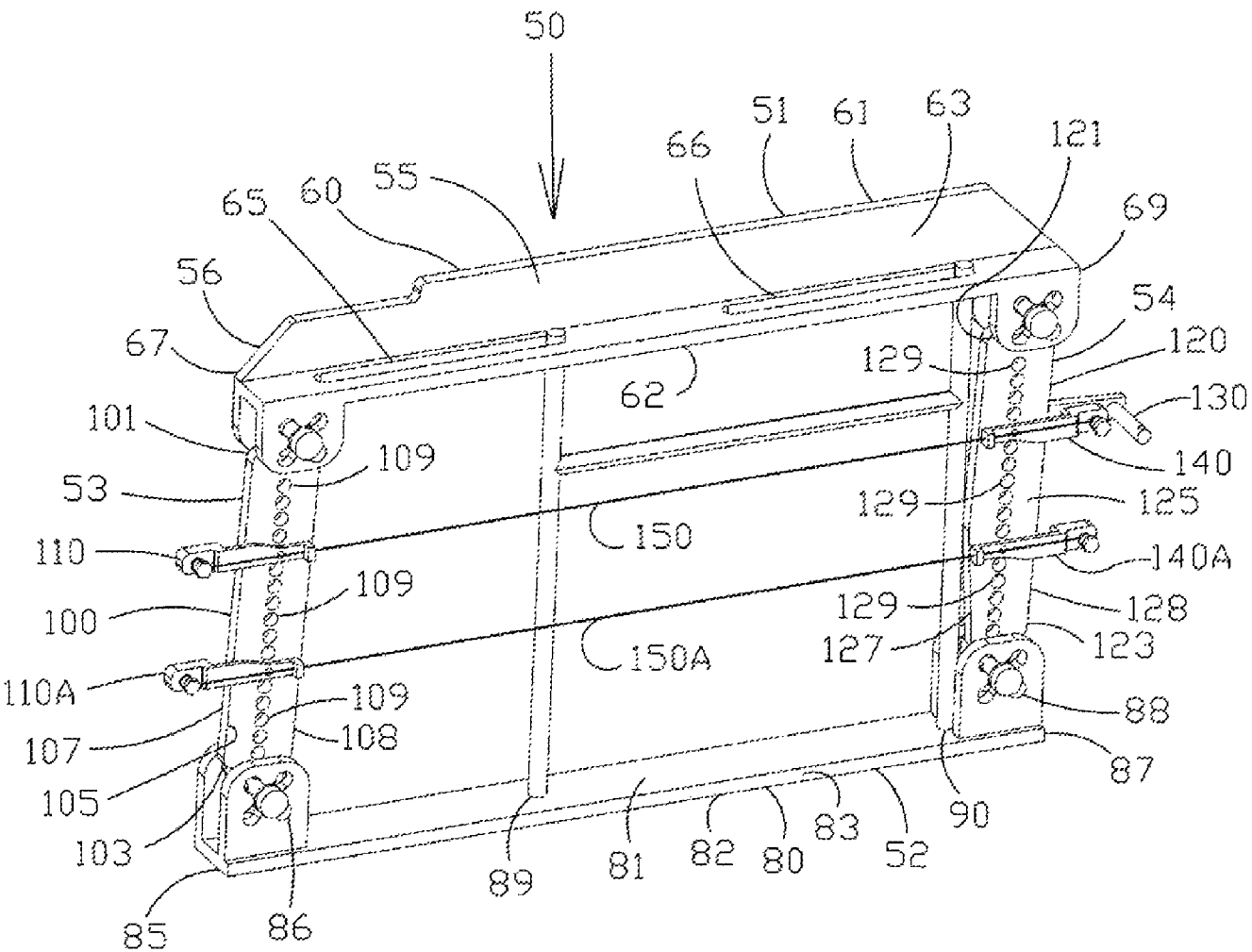
FIG. 9 is a perspective view of the preferred embodiment shown in FIG. 4, but now in an orientation of maximum divergence of the wires.
Figure 10:
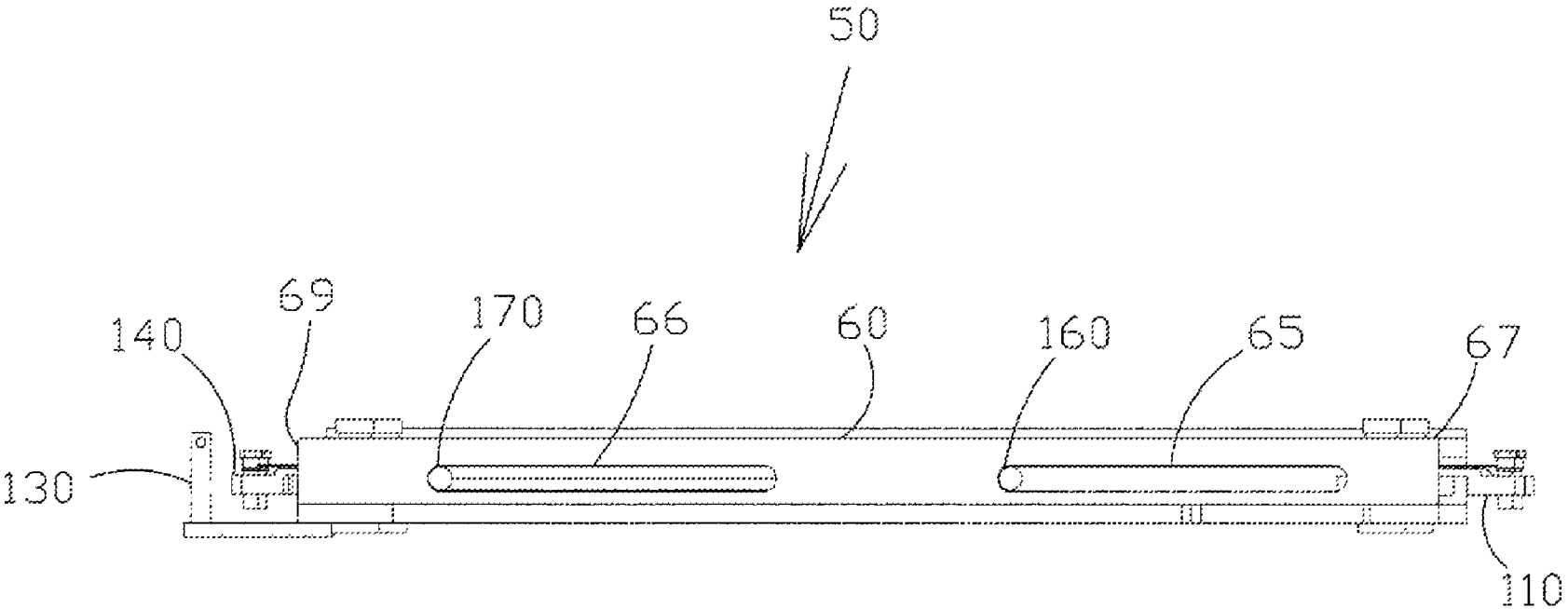
FIG. 10 is a top view of the preferred embodiment as shown in FIG. 8.

Turning now to FIGS. 9 and 10, the harp 50 is illustrated to be in a position wherein the wires are in a state of maximum divergence and minimum convergence. In this regard, the distance between the wires 150 and 150A is maximized when the harp 50 is in this illustrated position. The vertical bars 160 and 170 are all the way to a second end, respectively, of slots 65 and 66.

It is appreciated that the bars 160 and 170 of the present invention contact the wires. The location of this contact is adjacent the path of where the block 40 will pass. Accordingly, deflection of the wires are eliminated or minimized.

The harp 50 is easily inserted into and removed from channel 20. The channel provides longitudinal support to the harp 50.

It is appreciated that specific aspects of the present invention can be applied in series. For example, multiple (two or three) harps may be utilized to make precision sized pieces of material. In this regard, there would be multiple stages wherein a tilting harp of the present invention may be stationed in an alignment to slice in one of the length, width and/or height dimensions.

Thus it is apparent that there has been provided, in accordance with the invention, a machine with a tilting harp that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A machine comprising:

a frame;

a ram with a ram plate lying in a plate plane; and a harp supported by said frame, said harp comprising:

a first side arm;

a second side arm;

a top arm; and a bottom arm, wherein each of said first arm and said second arm is pivotally connected to both of said top arm and said bottom arm to form a tiltable parallelogram, wherein said first side arm remains parallel to said second side arm regardless of the amount of tilt of said harp, said first side arm and said second side arm supporting a first wire and a second wire, wherein said first wire is generally parallel to said second wire, and the distance between said first wire and said second wire is adjustable in a plane that is generally parallel to said plate plane as said harp tilts.

2. The machine of claim 1 wherein said first wire has a wire first end and a wire second end, said wire first end being supported by said first side arm and said wire second end being supported by said second side arm.

3. The machine of claim 2 wherein said machine further comprises:

a first holder pivotally connected to said first side arm and connected to said wire first end; and a second holder pivotally connected to said second side arm and connected to said wire second end.

4. The machine of claim 1 wherein said frame comprises a channel for removably receiving said harp, said channel orienting said harp in a plane that is generally parallel to said ram plate.

* * * * *